US006603933B1

(12) United States Patent
Foegelle

(10) Patent No.: US 6,603,933 B1
(45) Date of Patent: Aug. 5, 2003

(54) APPARATUS AND METHOD OF MODIFYING A LASER PRINTER TONER CARTRIDGE TO INCREASE TONER CAPACITY

(75) Inventor: John A. Foegelle, Broken Arrow, OK (US)

(73) Assignee: Electronic Label Technology, Inc., Broken Arrow, OK (US)

( * ) Notice: Subject to any disclaimer, the term of this patent is extended or adjusted under 35 U.S.C. 154(b) by 0 days.

(21) Appl. No.: 10/093,855

(22) Filed: Mar. 7, 2002

Related U.S. Application Data

(60) Provisional application No. 60/274,093, filed on Mar. 7, 2001.

(51) Int. Cl.[7] ..... G03G 15/08
(52) U.S. Cl. ..... 399/27; 399/109
(58) Field of Search ..... 399/27, 25, 106, 399/61, 12, 109, 258

(56) References Cited

U.S. PATENT DOCUMENTS 5,634,169 A 5/1997 Barry et al.

6,510,303 B2 * 1/2003 Bessette ..... 399/256

* cited by examiner

*Primary Examiner*—Sophia S. Chen
*Assistant Examiner*—Ryan Gleitz
(74) *Attorney, Agent, or Firm*—Fellers, Snider, Blankenship, Bailey & Tippens, P.C.

(57) ABSTRACT

A high yield laser printer toner cartridge for use with a Lexmark Optra series of laser printers and a method of modifying the toner cartridge so as to contain a added volume of toner without producing an error message. The toner cartridge including a hopper with a shaft having a first end and a second end extending through the hopper, such that a paddle disposed in the hopper rotates about the shaft, an encoder wheel which measures the volume of toner in the hopper secured to the first end of the shaft extending from the hopper and a drive gear having a face and a limit positioned on the face secured to the second end of the shaft, an arbor including a gap on its outer circumference bounded on one end by a shoulder secured to the second end of the shaft such that the limit is positioned in the gap of the arbor, a torsion spring having a first segment and a second segment where the first segment is mounted onto the drive gear and the second segment is mounted onto the arbor, and a stop secured on the face of the drive gear between the limit and the shoulder.

5 Claims, 4 Drawing Sheets

APPARATUS AND METHOD OF MODIFYING A LASER PRINTER TONER CARTRIDGE TO INCREASE TONER CAPACITY

CROSS REFERENCE TO RELATED APPLICATION

This application claims priority from copending U.S. provisional patent application Serial No. 60/274,093, filed Mar. 7, 2001, the disclosure of which is incorporated herein by reference.

BACKGROUND OF THE INVENTION

1. Field of the Invention

This invention relates to electrophotographic printers and specifically to toner cartridges for use with electrophotographic printers.

2. Background of the Invention

In an electrophotographic, or laser printer, ink is supplied in the form of toner which is in powder form stored in a container, or hopper, within an replaceable cartridge. In the Optra series of printers manufactured by Lexmark International, Inc. the standard size toner cartridge contains enough toner to print approximately 17,600 print sheets.

In a toner cartridge, the cost of the toner itself is relatively small in comparison to the total cost of the entire toner cartridge. A need, therefore, exists for a toner cartridge and method of modifying a Lexmark Optra series toner cartridge to include a larger volume of toner therein.

According to the manner in which a Lexmark Optra series laser printer operates, the level of toner in the toner cartridge is determined by the printer. The manner in which encoder wheel on the toner cartridge operates to determine the level of toner is described in U.S. Pat. No. 5,634,169, assigned to Lexmark International, Inc., Lexington, Ky., incorporated herein by reference.. If additional toner is supplied to the toner cartridge, an error message results and the printer becomes inoperational. A need, therefore, exists for a method of modifying a Lexmark Optra series laser printer toner cartridge so that additional toner can be supplied without receiving an error message.

SUMMARY OF THE INVENTION

It is an object of the present invention to provide a high yield laser printer toner cartridge of the type including a hopper with a shaft having a first end and a second end extending through the hopper, such that a paddle disposed in the hopper rotates about the shaft, an encoder wheel secured to the first end of the shaft extending from the hopper and a drive gear having a face and a limit positioned on the face secured to the second end of the shaft, an arbor including a gap on its outer circumference bounded on one end by a shoulder secured to the second end of the shaft such that the limit is positioned in the gap of the arbor, a torsion spring having a first segment and a second segment where the first segment is mounted onto the drive gear and the second segment is mounted onto the arbor, the improvement including positioning a stop on the face of the drive gear between the limit and the shoulder.

It is a further object of the present invention to provide a method of modifying a laser printer toner cartridge to produce a high yield laser printer toner cartridge of the type including a hopper containing a volume of toner therein, a shaft having a first end and a second end extending through the hopper such that a paddle disposed in the hopper rotates about the shaft, an encoder wheel secured to the first end of the shaft extending from the hopper and a drive gear having a face and a limit positioned on the face secured to the second end of the shaft, an arbor including a gap on its outer circumference bounded on one end by a shoulder secured to the second end of the shaft such that the limit is positioned in the gap of the arbor, a torsion spring having a first segment and a second segment where the first segment is mounted onto the drive gear and the second segment is mounted onto the arbor, the improvement wherein the improvement includes positioning a stop on the face of the drive gear between the limit and the shoulder and adding an additional volume of toner to the hopper.

Further objects, features, and advantages of the present invention will be apparent to those skilled in the art upon examining the accompanying drawings and upon reading the following description of the preferred embodiments.

DETAILED DESCRIPTION OF THE PREFERRED EMBODIMENT

The modified laser printer cartridge described with respect to the drawings and specification is designed for use in association with an electrophotographic printer such as are known in the art and available commercially from Lexmark International, Inc. The Lexmark cartridge, likewise is available commercially and has been described in U.S. Pat. Nos. 5,634,169, and 5,802,432, incorporated herein by reference. Therefore, neither the laser printer, nor the cartridge will be shown or described in detail herein.

Figure 1:
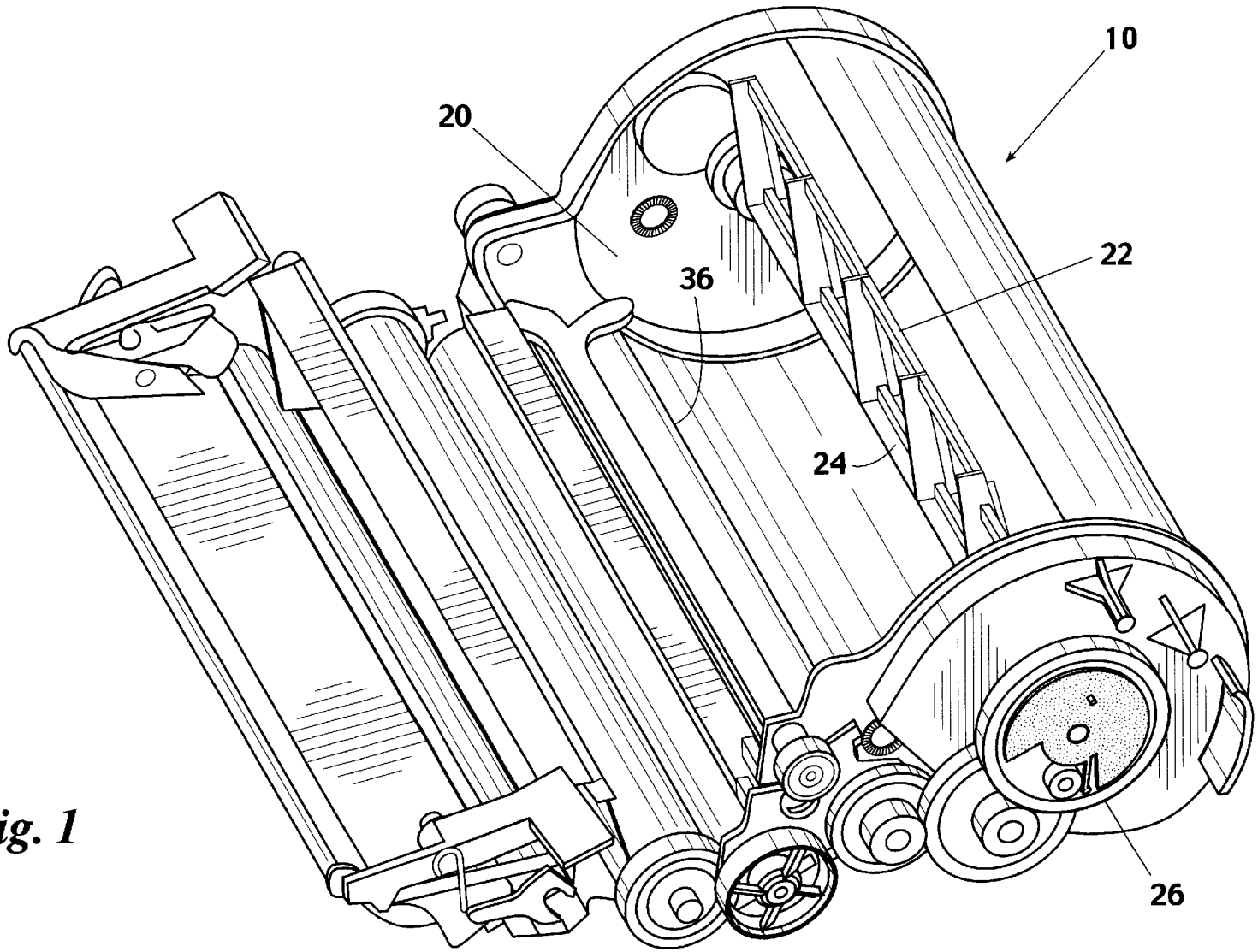
FIG. 1 is an isometric view of a representative laser printer cartridge including the modification of the present invention.

FIG. 1 is an isometric view of a laser printer cartridge 10 such as a cartridge for use in a Lexmark Optra series electrophotographic printer. Laser printer cartridge 10 of FIG. 1 has its cover elements removed exposing hopper 20 and paddle 22. Paddle 22 is disposed longitudinally within hopper 20 and is affixed within hopper 20 by a shaft 24. Paddle 22 is rotated by shaft 24 within hopper 20 so as to convey toner from hopper 20 (described further below). Paddle 22 further serves the purpose of assisting in the detection of the level of toner contained within hopper 20 which is reported by the printer.

FIG. 1 also shows paddle gear assembly 26. Paddle gear assembly 26 is the portion of print cartridge 10 which is modified according to the method of the present invention in order to allow substantially more toner to be added to hopper 20 which results in a high capacity print cartridge. By way of illustration, a standard toner cartridge available commercially is designed for 17,600 print sheets. After modification according to the present invention, including the supply of additional toner, the capacity of the cartridge may be increased to 25,000 print sheets, or almost a 50% increase in capacity.

Figure 2:
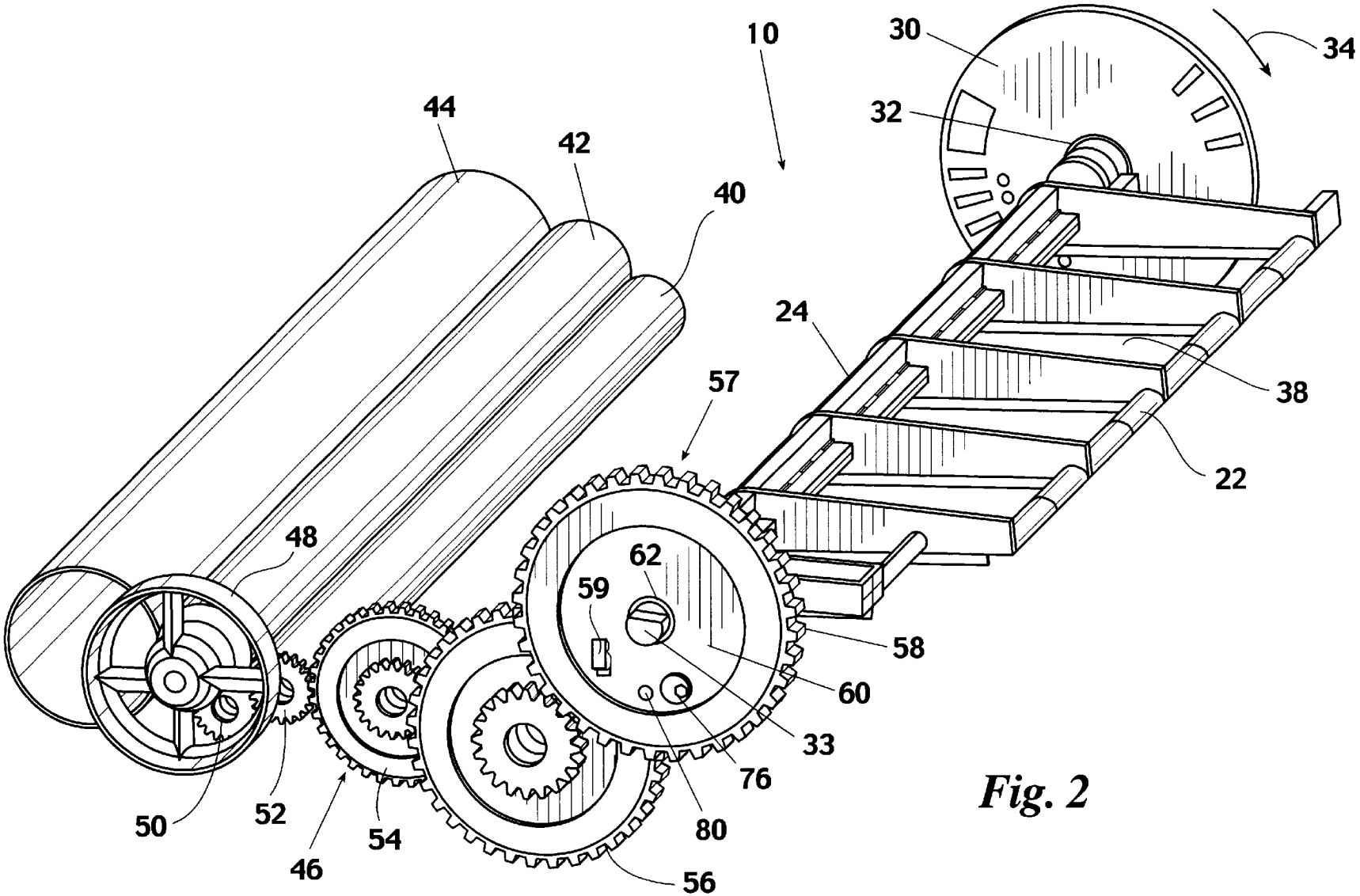
FIG. 2 is a partial cut away view of a modified paddle gear assembly of a laser printer cartridge.

In reference to FIG. 2, laser print cartridge 10 includes an encoder wheel 30 adapted for coaction with an encoder wheel sensor or reader when the cartridge 10 is nested in its home position within the laser printer. The encoder wheel reader transmits information concerning cartridge characteristics to the printer. This information includes the amount of toner remaining within the cartridge.

The encoder wheel 30 is mounted on one end 32 of shaft 24. As described above, shaft 24 is coaxially mounted for rotation within hopper 20 (FIG. 1). Paddle 22 is mounted on shaft 24 for synchronous rotation with encoder wheel 30. Paddle 22 extends radially from shaft 24 perpendicular to the axis of hopper 20. As paddle 22 rotates counter clockwise in the direction of the arrow 34, toner tends to be moved over a sill 36 (FIG. 1) of the hopper 20 to supply toner necessary for the electrophotographic printing process. The paddle 22 is conventionally provided with gaps 38 to provide lower resistance as paddle 22 passes through the toner contained within hopper 20.

The toner that is forced over sill 36 (FIG. 1) is deposited onto a toner adder roll 40, which interacts in a known manner with a developer roll 42 and then a photo conductive (PC) drum 44 which is in the media path for applying text and graphical information to the print receiving media (such as paper or vinyl label stock) passing through the media path.

A drive motor (not shown) is coupled through suitable gearing and drive take-offs to provide multiple and differing drive rotations to, for example, the PC drum 44 and a drive train 46 for the developer roll 42, the toner adder roll 40 and through a variable torque arrangement, to one end 33 of the shaft 24. This variable torque assembly, described below is mounted to shaft 24 opposite encoder wheel 30.

The drive motor may be of any acceptable type such as a stepping motor, or most commonly a brush less DC motor. A brush less DC motor is particularly suited for this application because of the availability of either hall effect or frequency generated feedback pulses which present measurable and finite increments of movement of the motor shaft. The feedback accounts for a predetermined incremental distance measurement (increment).

The drive train 46, which in the present instance forms part of laser print cartridge 10, includes drive gear 48, which is directly coupled to the developer roll 42. Drive gear 48 is also coupled to the toner adder roll 40 by gear 52 through an idler gear 50. Gear 52, using suitable reduction gears 54 and 56, drivingly engages drive gear 58. Drive gear 58 is coupled to the end 33 of shaft 24 through a variable torque sensitive coupling assembly 28. Variable torque sensitive coupling assembly 28 is depicted assembled in FIGS. 4 and 5. Variable torque sensitive coupling assembly 28 includes a driven half and a trailing half. It is the modifications to variable torque sensitive coupling assembly 28 which allow for an increase in the toner capacity of laser print cartridge 10.

In FIG. 2, the driven half 57 of variable torque sensitive coupling assembly 28 is shown. Driven half 57 of variable torque sensitive coupling assembly 28 includes drive gear 58, spring retainer 59, limit 76, and stop 80. Drive gear 58 is shown as including an attached face 60 connected to a collar 62. Collar 62 acts as a bearing permitting free movement of drive gear 58 and face 60 about the end 33 of shaft 24. However, this free movement is limited by the remaining assembly, below. Thus, driven half 57 of variable torque sensitive coupling assembly 28 is described.

Figure 3:
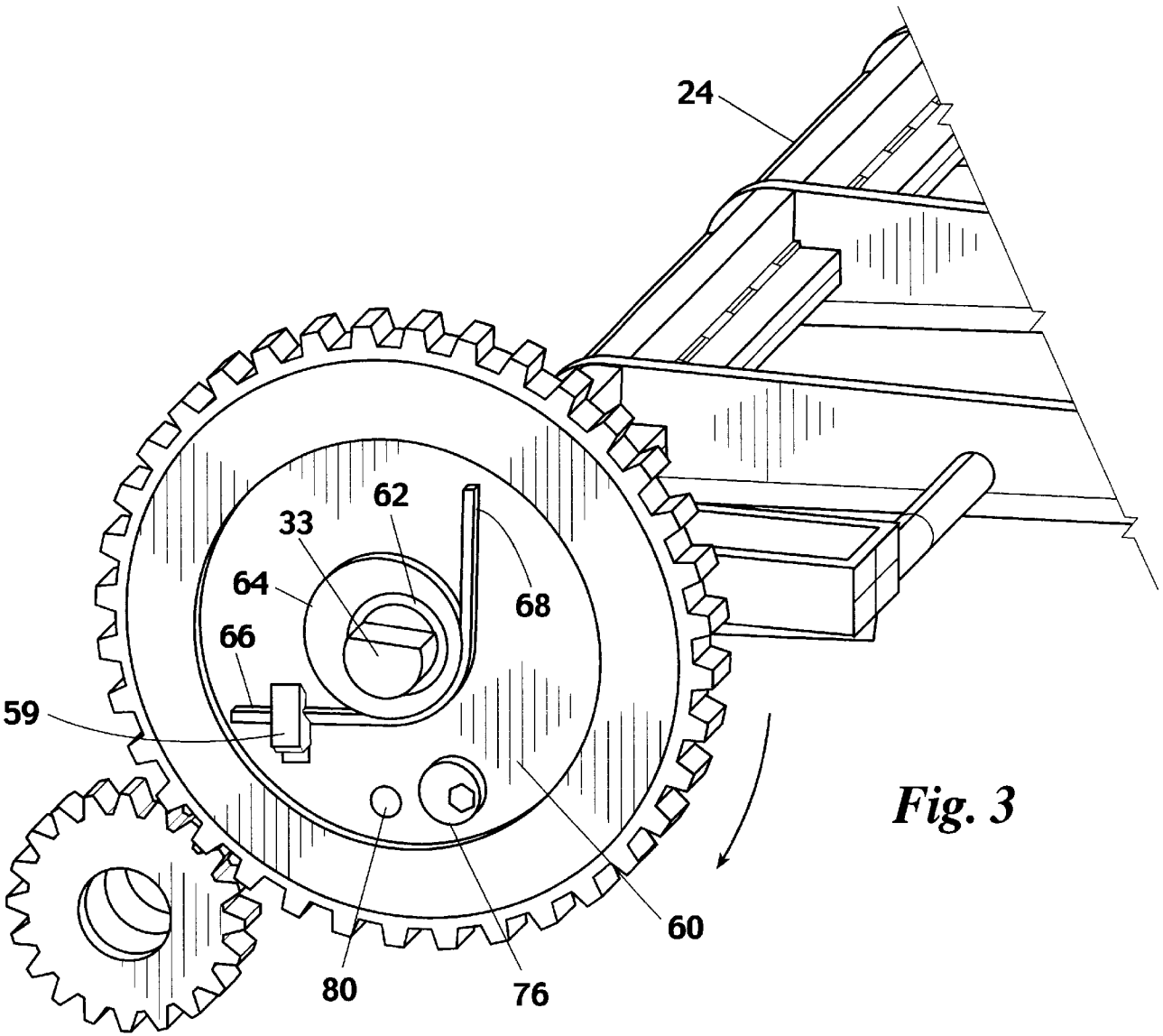
FIG. 3 is a partial view of the interior component parts of the laser printer cartridge of FIG. 1, and specifically the encoder wheel, shaft, paddle, and partial paddle gear assembly.
Figure 4:
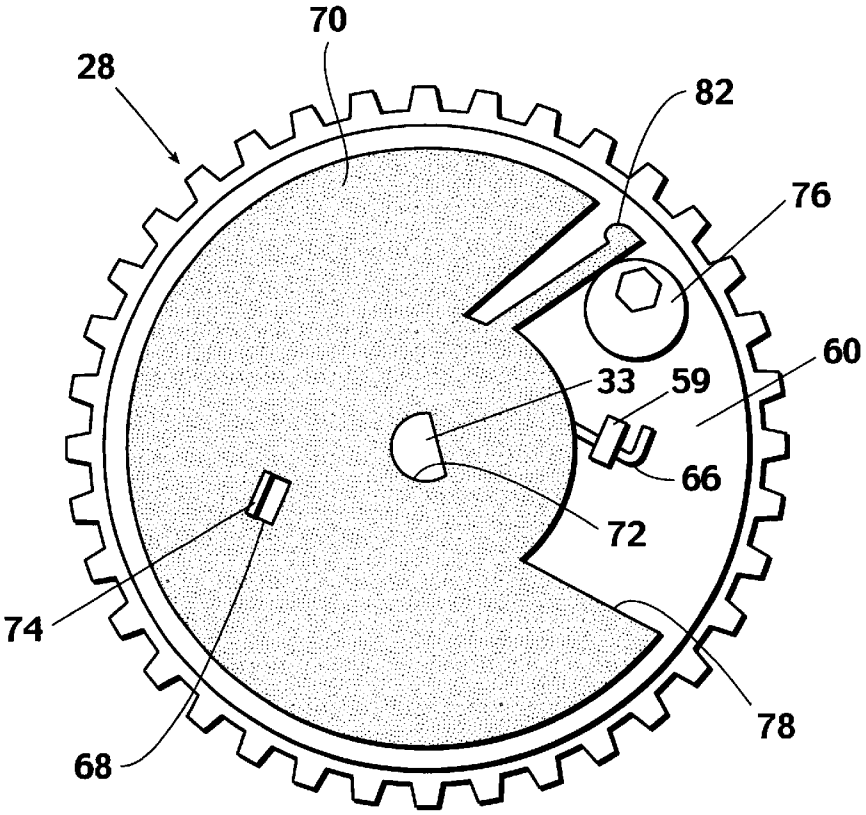
Fig. 4 (PRIOR ART)
FIG. 4 is an end view of a paddle gear assembly of the prior art.

Referring next to FIG. 3, taken in combination with FIG. 4, the trailing half of the variable torque sensitive coupling assembly 28 is described. The trailing half of variable torque sensitive coupling assembly 28 includes spring 64 and arbor 70. The trailing half of torque sensitive coupling assembly 28 is mounted on the face 60 of drive gear 58. Torsion spring 64 is mounted onto face 60 of drive gear 58 between face 60 and arbor 70. Torsion spring 64 includes two segments. One segment 66 of torsion spring 64 is secured to the face 60 of drive gear 58 by spring retainer 59. The other segment 68 of torsion spring 64 is not secured to final drive gear 58 but rather to the inside surface of arbor 70 by means of spring retainer 59 (FIG. 4).

Figure 5:
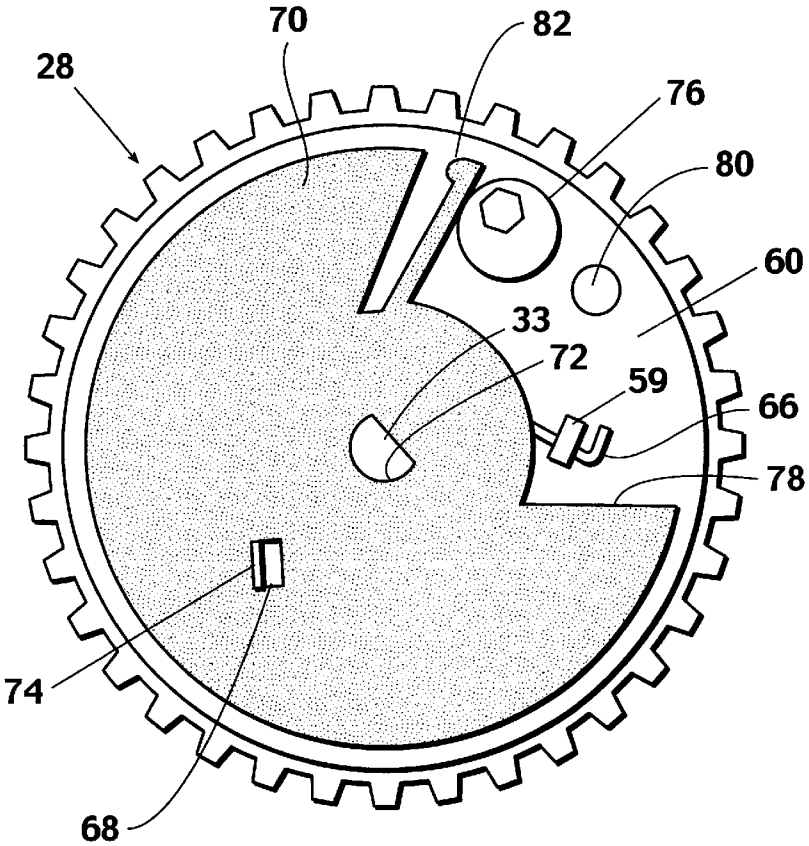
FIG. 5 is an end view of the paddle gear assembly of FIG. 4 including the modification of the present invention.

Turning now to FIGS. 4 and 5, arbor 70 of the trailing half of variable torque sensitive coupling assembly 28 is illustrated. Arbor 70 includes a keyed central opening 72 dimensioned for receiving the keyed (flat) end 33 of shaft 24. Arbor 70 includes shoulder 78 and damper 82 which together bound a gap in the circumference of arbor 70. Limit 76 and stop 80 are positioned within this cut-out when variable torque sensitive coupling assembly 28 is assembled.

When variable torque sensitive coupling assembly 28 is assembled, one segment 66 (FIG. 3) of spring 64 is connected to the face 60 of drive gear 58, while the other end 68 of spring 64 is connected to arbor 70 by way of spring clip 74. Arbor 70 is, in turn, keyed to shaft 24 mounted for rotation in and through hopper 20 of laser print cartridge 10 (FIG. 1).

Drive gear 58 is connected to shaft 24 through spring 64 and arbor 70. As drive gear 58 rotates, segment 68 of spring 64 presses against spring clip 74 on the reverse side of arbor 70. The force exerted by segment 68 of spring 64 against spring clip 74 causes arbor 70 to rotate. Rotation of arbor 70 also rotates shaft 24 since end 33 of shaft 24 is keyed to mate arbor 70. Rotation of shaft 24, in turn, causes paddle 22 to rotate.

When paddle 22 encounters toner in hopper 20, a resistance is applied against paddle 22. The amount (volume) of toner contained in hopper 20 determines the amount of resistance. This resistance causes torsion spring 64 to compress and thereby causes arbor 70 to lag the rotational position of drive gear 58. Since encoder wheel 30 is mounted on shaft 24 opposite arbor 70, lag of arbor 70 produces a corresponding lag in encoder wheel 30. The lag is then measured by a reader in the laser printer which identifies the level of toner in hopper 20.

Once arbor 70 begins to lag the rotational position of drive gear 58, limit 76 is rotated off its resting position against damper 82. This resistance, or lag, causes limit 76 to rotate from damper 82 toward shoulder 78. The greater the resistance encounter because of toner against paddle 22, the greater the lag force. Torsion spring 64 maintains a resistive force against the lag force.

As stated, spring 64 allows shaft 24 to lag relative to drive gear 58 and drive train 46 (FIG. 2) because of the resistance encountered against the toner as paddle 22 attempts to move through hopper 20. The greater the resistance encountered because of toner against paddle 22, the greater the lag. The difference in distance traveled by drive gear 58 and the encoder wheel 30, as paddle 22 rotates through hopper 20 counter clockwise from the 9:00 position to about the 5:00 position, is a measure of the amount of toner remaining in hopper 20, and by extension, the number of print sheets which may yet be printed by the laser printer before laser print cartridge 10 is low on toner.

In the prior art assembly of FIG. 4, limit 76, mounted on face 60 of drive gear 58 prevented over winding or excessive stressing of spring 64 by contacting shoulder 78 of arbor 70.

In instances where the hopper 20 is at the full level of toner, limit 76 did not engage shoulder 78 but the amount of resistance was such that limit 76 stopped short of shoulder 78. If additional toner were to be added to hopper 20, additional resistance against paddle 22 would result. In this event, limit 76 would approach or contact shoulder 78 producing an excessive toner situation which resulted in an error message on the laser printer.

In the modification of the present invention, a stop 80 is added to face 60 of drive gear 58 between limit 76 and shoulder 78. The result of this modification is that stop 80 will contact shoulder 78 before limit 78 thereby preventing limit 78 from reaching its over limit threshold. In addition, torsion spring 64 may be replaced with a stiffer torsion spring which limits the lag between drive gear 58 and arbor 70 (and encoder wheel 30). Accordingly, a greater volume of toner can be supplied to hopper 20 without encoder wheel 30 producing an excessive toner error in the laser printer.

While the invention has been described with a certain degree of particularity, it is manifest that many changes may be made in the details of construction without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. A high yield laser printer toner cartridge of the type including a hopper with a shaft having a first end and a second end extending through the hopper, such that a paddle disposed in the hopper rotates about the shaft, an encoder wheel secured to the first end of the shaft extending from the hopper and a drive gear having a face and a limit positioned on the face secured to the second end of the shaft, an arbor including a gap on its outer circumference bounded on one end by a shoulder secured to the second end of the shaft such that the limit is positioned in the gap of the arbor, a torsion spring having a first segment and a second segment where the first segment is mounted onto the drive gear and the second segment is mounted onto the arbor, the improvement comprising:

a stop secured on the face of the drive gear between the limit and the shoulder to engage said shoulder thereby limiting rotation of said arbor.

2. A method of modifying a laser printer toner cartridge to produce a high yield laser printer toner cartridge of the type including a hopper containing a volume of toner therein, a shaft having a first end and a second end extending through the hopper such that a paddle disposed in the hopper rotates about the shaft, an encoder wheel secured to the first end of the shaft extending from the hopper and a drive gear having a face and a limit positioned on the face secured to the second end of the shaft, an arbor including a gap on its outer circumference bounded on one end by a shoulder secured to the second end of the shaft such that the limit is positioned in the gap of the arbor, a torsion spring having a first segment and a second segment where the first segment is mounted onto the drive gear and the second segment is mounted onto the arbor, the improvement comprising:

positioning a stop on the face of the drive gear between the limit and the shoulder;

adding an additional volume of toner to the hopper.

3. A variable torque sensitive coupling assembly for a laser printer toner cartridge, comprising:

a drive gear including a face;

a limit positioned on said face;

an arbor positioned adjacent said drive gear;

said arbor including a shoulder thereon;

a stop positioned on said face of said drive gear between said limit and said shoulder of said arbor;

a spring including a first segment and a second segment;

said spring being supported from said drive gear such that said first segment of said spring abuts against said drive gear and said second segment of said spring abuts against said arbor.

4. The variable torque sensitive coupling assembly of claim 3 wherein said first segment of said spring abuts and is engaged in a spring retainer secured to said drive gear.

5. The variable torque sensitive coupling assembly of claim 4 wherein said second segment of said spring abuts and is engaged in a spring retainer secured to said arbor.

* * * * *